United States Patent [19]

Freddi

[11] 4,055,027

[45] Oct. 25, 1977

[54] METHOD AND RELATIVE DEVICE FOR CHECKING THE WORKING CONDITIONS DURING THE GRINDING IN CENTERLESS GRINDERS

[75] Inventor: Tomaso Freddi, Bologna, Italy

[73] Assignee: Finike Italiana Marposs Soc. In Accomandita Semplice di Mario Possati & C., Bentivoglio, Italy

[21] Appl. No.: 441,287

[22] Filed: Feb. 11, 1974

[30] Foreign Application Priority Data

Feb. 9, 1973 Italy ..... 3326/73

[51] Int. Cl.[2] ..... B24B 41/06

[52] U.S. Cl. ..... 51/238 GG; 51/103 WH; 51/165.77; 51/289 R

[58] Field of Search ..... 51/238 R, 238 S, 238 CG, 51/103 R, 103 WH, 165 R, 165.77, 165.83, 165.91, 281 R, 289 R

[56] References Cited

U.S. PATENT DOCUMENTS

| | | | |
|---|---|---|---|
| 2,861,399 | 11/1958 | Landius | 51/103 R |
| 3,503,159 | 3/1970 | Schaller | 51/238 R |
| 3,807,098 | 4/1974 | Schaller | 51/165.91 |

*Primary Examiner*—Harold D. Whitehead
*Attorney, Agent, or Firm*—Stevens, Davis, Miller & Mosher

[57] ABSTRACT

A measuring and control method to check the position and/or wear of a knife element supporting a piece being machined in centerless grinders including foreseeing the generation of signals responsive to the position of the workpiece surface close to the supporting knife element and comparing the signals with reference signals depending on the workpiece size and the optimum position of the supporting knife element. The result of the comparison is responsive to the real position and/or wear of the supporting knife element. A device for the method which comprises a gauge for measuring linear dimensions having at least one moving element adapted to cooperate with the surface of the piece being machined. The moving element is associated to position transducer means connected with threshold circuits to control alarm and control circuits, the control and alarm circuits being responsive to the wear and/or position of the supporting knife element.

7 Claims, 4 Drawing Figures

METHOD AND RELATIVE DEVICE FOR CHECKING THE WORKING CONDITIONS DURING THE GRINDING IN CENTERLESS GRINDERS

The present invention relates to a method and relative measuring and control device adapted to check the working conditions during grinding in centerless grinders.

Particularly but not exclusively the invention regards the checking of the position and/or the wear of the blade or supporting knife in centerless grinders carrying out a "plunge" machining. As it is known, centerless grinders are machines with a very high hourly output. In a known type of such machines the workpieces to be ground (having the shape of rotation solids) are placed between two facing grinding wheels revolving in the same direction at different speeds.

The workpiece being machined is supported by a knife of very hard steel which pushes it towards one of the grinding wheels known as the feeding wheel (or control or regulating wheel).

The workpiece substantially takes the rim speed of the feeding wheel and is ground by the other wheel called the working wheel. A "through feed" or "plunge" machining can be carried out. In the "through feed" method used for cylindrical pieces the workpieces also receive an axial translation motion from the feeding wheel and are ground during this translation.

Grinding wheels are kept at a constant distance. The final diameter of the piece depends on the distance between grinding wheels and on the position of the supporting knife. The "plunge" method is suitable for non-cylindrical pieces, presenting for instance projections, collars or non-rectilinear generating lines.

In such a case wheels are shaped with corresponding shapes and are approached gradually during the machining, until the piece reaches the desired size and shape.

The loading and unloading of workpieces are carried out manually or by suitable loaders and expellers.

It also is known to use measuring devices, in particular electronic or pneumatic comparators, to check the piece size during the machining or just after it and to control the feed or the adjustment of the wheel positions on the basis of the measuring signals.

These comparators include transducers which generate electric or pneumatic measuring signals following the displacements of arms or other moving elements.

When working conditions and overall dimensions make it possible, it is preferred to use comparators fitted with two moving arms having feelers contacting the workpiece in diametrically opposite positions.

Moving arms are associated with relevant transducers whose output signals are added up giving the value of the workpiece diameter, or rather its deviation from the nominal value. The position of the axes of the workpieces when they are brought succeedingly between grinding wheels and machined there is not invariable.

This occurs in a small measure owing to the size changes of every piece following the removal and to an extent, which may be much more considerable, owing to the wear of the supporting knife.

As a matter of fact the knife is highly stressed and though it is very hard, it goes through a wear which becomes more than negligible as the number of machined workpieces grows and may negatively affect both the machining quality directly and the measuring precision of the piece size.

To attain good machining quality, with no errors in shape, the axes of the workpieces should remain in a well determined position with respect to the axes of the wheels.

Contrary to this desired relationship, the wear of the supporting knife averagely causes a lowering of the axis (in the case of horizontal grinders) and makes the position of the axis unstable.

The piece may undergo oscillations while being ground and it may happen that it revolves no longer in synchronism with the feeding wheel.

Thus, it follows that when the axis is lowered the machined piece presents considerable error in shape, which may result in it not being usable. Although it is possible to keep feelers in a diametral position on the piece, the axis of the workpiece moves in such a way that the moving arms do not work with spacings symmetrical with respect to the rest position.

Therefore it may happen that one or both transducers go out of the linear response range and consequently the measuring signal loses the needed precision. This normally is described as transducers going out of their electric matching range.

The object of the present invention is to provide a measuring and control method through which the position and/or the wear of the elements supporting the workpiece in centerless grinders can be automatically detected, without stopping the machining.

A further object of the present invention is to provide a device which can correctly measure the workpiece size during its machining besides detecting the wear of the supporting element.

These and other objects are achieved by a measuring and control method to check the working conditions in centerless grinders, in particular to check the position and/or the wear of the element supporting the workpiece being machined. The method consists in obtaining signals responsive to the position of the workpiece surface close to the supporting elements when the workpiece is placed on the machine in order to be machined, and in comparing said signals with reference signals depending on the size of the piece and on the optimum position of the supporting element, the signals resulting from the comparison being responsive to the real position and/or the wear of the supporting element. The device of the present invention embodying the method, includes a per se known gauge for measuring linear dimensions having at least one moving element or arm adapted to cooperate with the surface of the piece being machined, the moving element being preferably placed close to the supporting element and associated to known transducer and detecting circuits to detect the wear of the supporting element on the basis of the position of the piece surface.

According to a particular embodiment of the device of the present invention, the gauge is a comparator of the type having two moving arms associated with relevant transducers, generally used to gauge the workpiece size during the machining, the output signal of one of the transducers, besides being added to the output signal of the other transducer, in order to gauge the size of the workpiece, is brought to a threshold circuit which commutates when said signal exceeds a pre-set value. According to the invention, the threshold level circuit can be associated to a device adapted to automatically carry out the compensation of the supporting element wear.

The invention now will be described in more detail with reference to the enclosed drawings given by way of illustration and not of limitation in which equal or equivalent parts are marked by the same reference numbers and in which.

Figure 1:
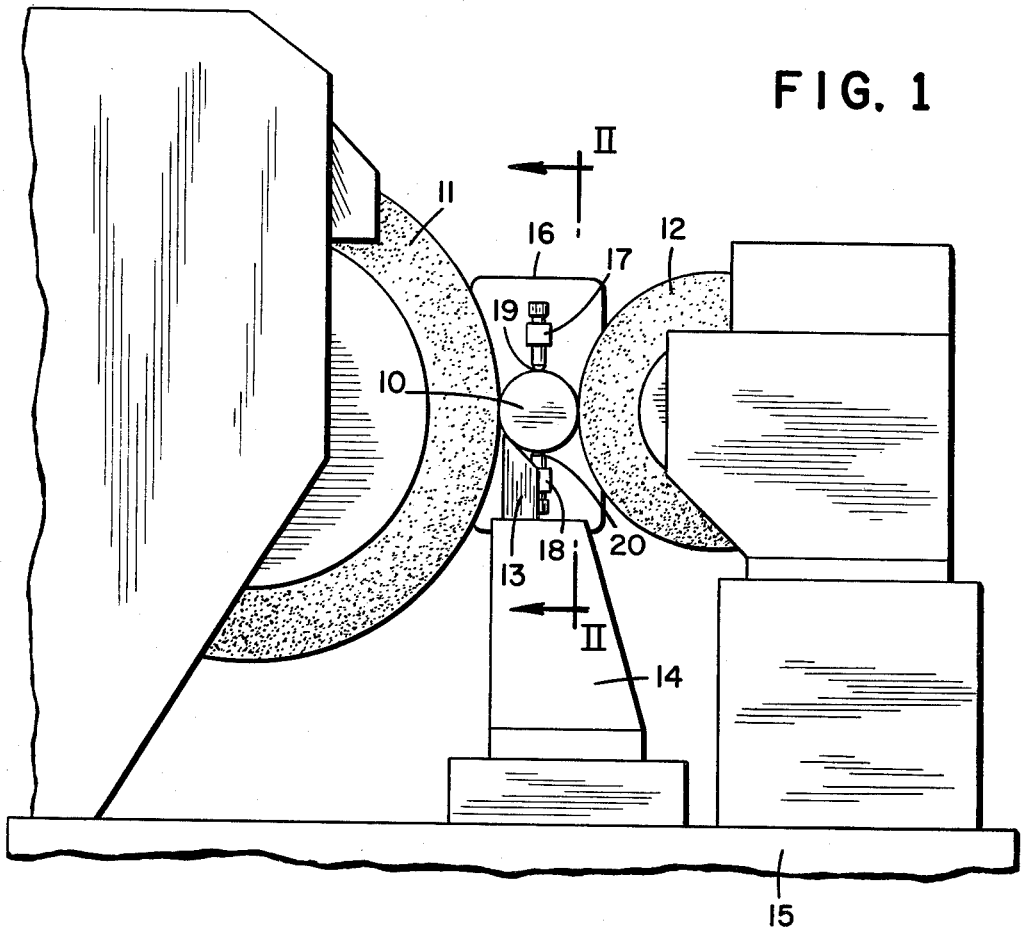
FIG. 1 represents a schematic front view of an embodiment of the device according to the present invention used on a horizontal centerless grinder carrying out a plunge machining, in which the workpiece is gauged during the grinding.
Figure 2:
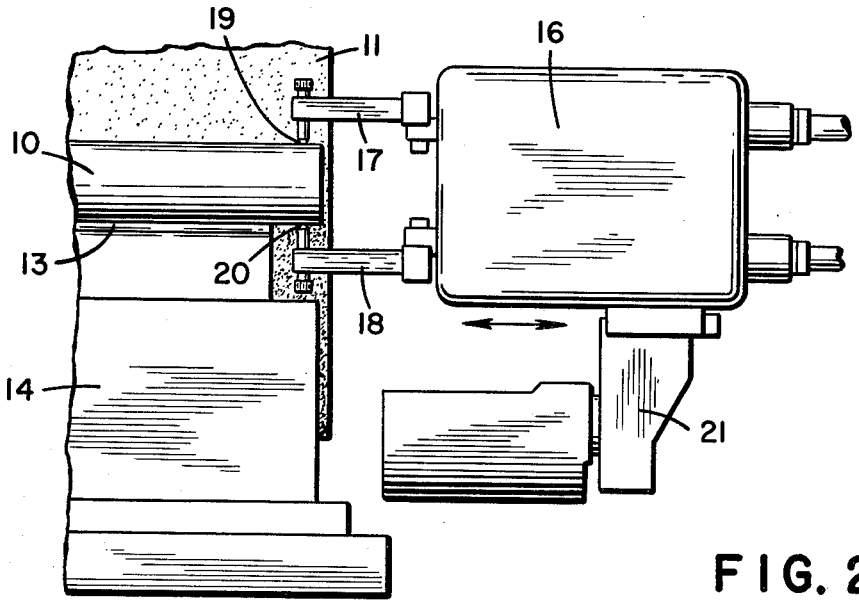
FIG. 2 is a partial longitudinal section according to the line II—II of FIG. 1.

With reference to FIGS. 1 and 2, the piece 10 to be ground is placed between a working wheel 11 and a feeding wheel 12. Piece 10 is supported by a knife 13 mounted on a support 14 associated with the bed 15 of the machine.

An electronic comparator 16 including two moving arms 17, 18 with relevant feelers 19, 20 is able to gauge the piece during its grinding and to control the machine cycle.

Comparator 16 is mounted on a slide 21.

The electronic circuits of comparator 16 include a supply circuit 25 connected with an oscillator 26 supplying stabilized alternating voltage to transducer circuits 27, 28 fitted with inductive transducers 29, 30.

The impedance of transducers depends respectively on the position of moving arms 17, 18 (FIG. 2).

Circuits 27, 28 are connected at the output with detecting circuits 32, 33 which rectify the input alternating voltages providing output unidirectional voltages which are brought to an adding unit 36 through normally closed switches 34, 35.

The output signal of adding unit 36, depending on the distance between feelers 19, 20 (FIG. 2) is visualized by an indicating device 38 and is fed to a control group 39 which can control the different phases of the machining cycle on the basis of the values taken by the signal itself.

Figure 3:
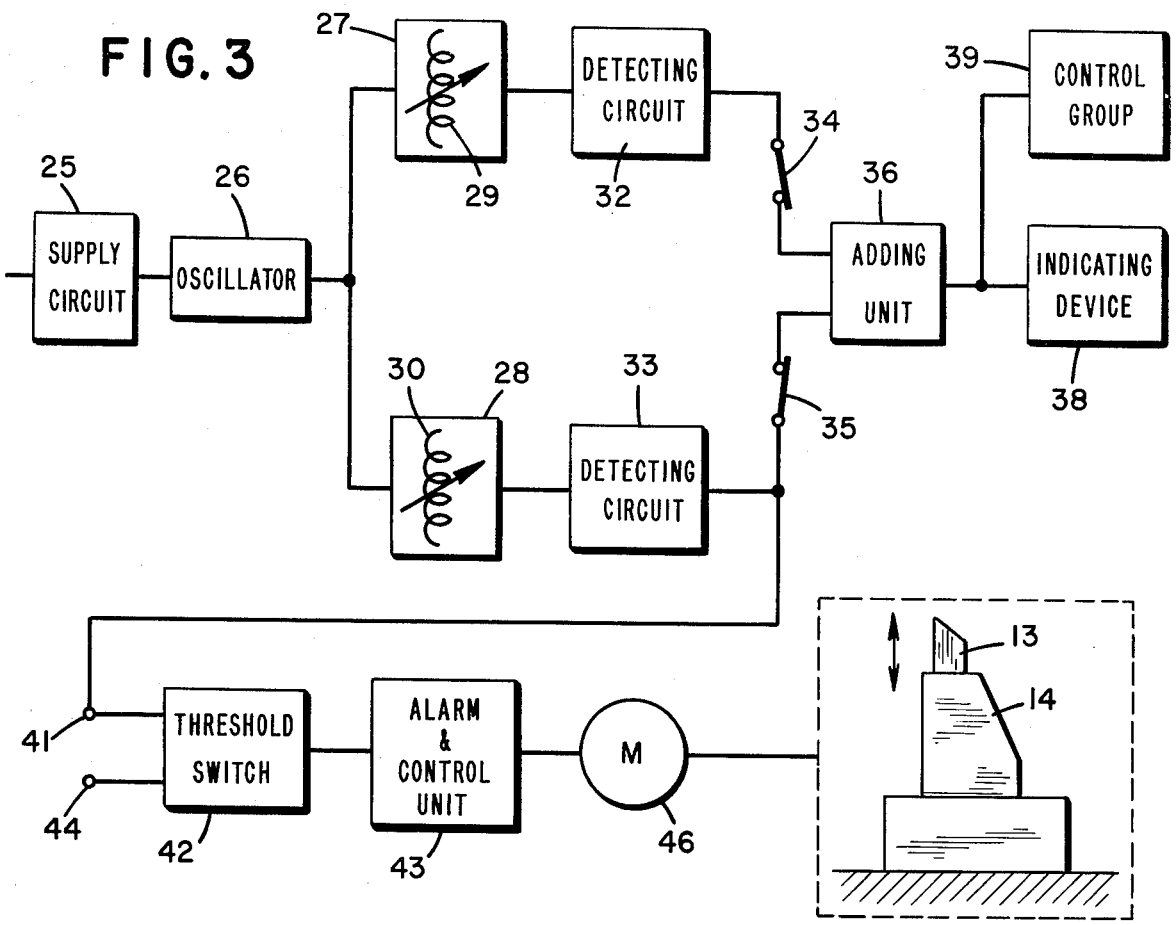
FIG. 3 is a bloc diagram of the electric circuits of the device of FIGS. 1 and 2.

The components of the device of FIG. 3 described up to now and their functions are already known substantially.

The control of the position and/or the wear of supporting knife 13 is carried out by using the output signal of detecting circuit 33, i.e., the signal responsive to the position of feeler 20. This feeler 20 contacts the surface of piece 10 in proximity to supporting knife 13, as is shown in FIGS. 1 and 2.

With reference to FIG. 3, the output of detecting circuit 33 is connected with the input terminal 41 of an electronic threshold switch 42 controlling an alarm and control unit 43.

Electronic threshold switch 42 has a control terminal 44 on which a reference voltage is applied chosen on the basis of the sizes of workpiece 10 and the optimum position of knife 13 (that is of piece 10 during the machining).

When the voltage at terminal 41 is higher than that at terminal 44, electronic switch 42 commutates and thereby operates unit 43. This happens when the wear of knife 13 has reached too high a value or, in any case, when the position of piece 10 does not permit a satisfactory working quality or a sufficiently exact measurement of the workpiece size.

Alarm and control unit 43, besides signalling (for instance by lighting lamps) the irregular situations, causes the operation of a motor 46 which adjusts the position of knife 13 by lifting it with respect to support 14.

The position of knife 13 may be corrected by adjustments having a pre-established amplitude or an amplitude proportional to the error signal. It is sufficient, for this purpose, to use suitable circuits to realize blocks 42, 43, 46. These circuits are not directly concerned with the invention. However, they are well known and therefore are not described in detail.

The displacement of the knife can be obtained by a precision system with screw-nutscrew or rack-and-pinion (or the like, not shown in the Figures). It is known that in centerless grinders workpieces may undergo undesired displacements when they are placed on the supporting knife. This occurs above all when the knife itself suffers a more than negligible wear or when it is in a wrong position.

Displacements of the axis of the piece may also happen in consequence of the wear of the feeding wheel; this wear is however very low, normally. However, a proper choice of comparator 16 prevents such undesired displacements from negatively affecting the working precision of the device described now.

To this end the comparators of the type described in U.S. Pat. No. 3,345,753 are particularly suitable, having moving arms associated to hydraulic dampers.

By the just described device two important results are achieved: the working quality is improved because supporting knife 13 is kept in the most suitable position and the risk that transducers 29, 30 of comparator 16 go out of their coupling range is avoided. It also is possible to measure the wear suffered by the supporting knife and to have exact indications about the operation zone of transducer 30.

For these purposes it suffices to open switch 34; indicating device 38 then provides the measurement of the output signal of detector 33 only, from which the above mentioned information can be drawn.

Figure 4:
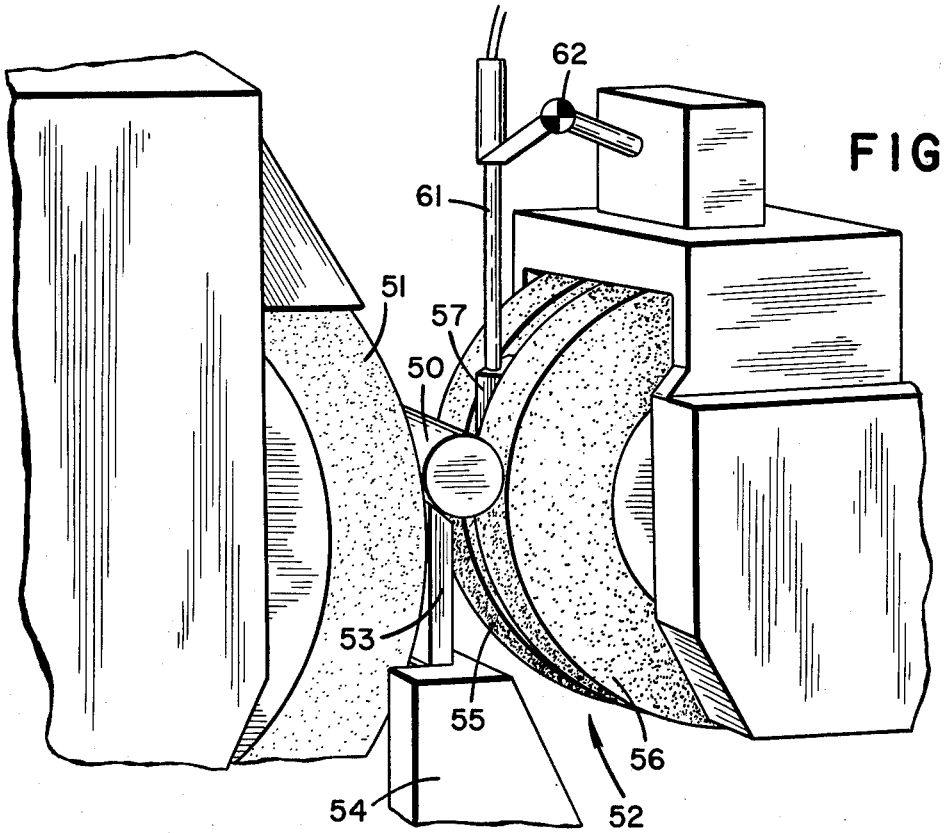
FIG. 4 is a sketch representing another embodiment of the device according to the present invention particularly suitable for centerless grinders carrying out a through-feed machining.

In the application illustrated in FIG. 4 relating to a centerless grinder carrying out a through-feed machining, piece 50 is placed, as usual, between a working wheel 51 and a feeding wheel 52 and is supported by a knife 53 associated with a support 54.

The feeding wheel is made up of two parts 55, 56 between which there is the head 57 of a comparator with one moving arm and the relevant feeler (not shown in the figure).

Head 57 is supported by a rod 61 which can revolve around a fulcrum 62 so as to bring head 57 to a measuring position or to remove it from piece 50.

During the measurement, however, rod 61 is locked by means not shown. The electric circuits and the operation of the device of FIG. 4 can be drawn from what has been said formerly with referecne to FIG. 3. Of course, in this case only the wear of knife 53 and not the diameter of piece 50 is detected.

It is evident that the invention may be also advantageously used for the grinders in which the workpiece is rotated by a magnetic spindle and is supported by shoes (usually two shoes) instead of by a knife. These machines, too, may be considered centerless grinders. In this case the position of the workpiece and the wear of the shoes can be detected by using one or more feelers adapted to contact the piece near the shoe or shoes. Particularly it is possible to use measuring heads having axially moving feelers placed near the shoes or in holes obtained through the shoes.

I claim:

1. A method for checking the working conditions during the machining in centerless grinders in which the workpiece being machined is supported by support means having a surface contacting the outer surface of the workpiece, comprising:

generating a first measurement signal responsive to the position of the workpiece outer surface at a point close to said support means surface;

generating a second measurement signal responsive to the position of the workpiece outer surface at the point located diametrically opposite to the preceding point;

processing said first and second measurement signals to obtain a third signal responsive to the workpiece diameter; and comparing said first measurement signal with a reference signal to obtain a signal responsive to the real position of said support means surface.

2. The method according to claim 1, further comprising the step of utilizing said first measurement signal to provide an indication of the wear of the support means.

3. A method for checking the working conditions and controlling the machining in centerless grinders including support means having a surface contacting a workpiece being machined, said workpiece being driven in rotation on said surface, comprising:

generating a first measurement signal responsive to the position of the workpiece surface at a point close to said support means surface;

generating a second measurement signal responsive to the position of the workpiece surface at the point located diametrically opposite to the preceding point;

processing said first and second measurement signal to obtain a third measurement signal, responsive to the workpiece diameter;

utilizing said first measurement signal for automatically controlling adjustments of the position of the support means; and utilizing said third measurement signal for in-process controlling the machining cycle.

4. A device for checking the working conditions during the machining in centerless grinders in which the workpiece being machined is supported and driven in rotation on a surface of support means, comprising:

a measuring gauge head including a first movable arm coupled to a first position transducer and a second movable arm coupled to a second position transducer, the gauge being located in a position to keep said first arm in cooperation with the workpiece surface at a point close to said support means and to keep said second arm in cooperation with the workpiece surface at a point opposed to the preceding point;

gauge circuits connected to said first and second position transducers and including a first circuit for processing the signals of both the transducers to provide a signal responsive to the diameter of the workpiece and a second circuit connected to the first transducer to provide a signal responsive to the position of said support means surface.

5. The device according to claim 4, wherein said gauge circuits have an output connected to a visualizing instrument for providing an indication of the operating range of said transducers.

6. The device according to claim 4, wherein said first circuit is connected to an indicating instrument for indicating the sizes of the workpieces and wherein the first circuit includes switch means for switching off the signal provided by the transducer coupled to the second arm and feeding to the indicating instrument only the signal provided by the transducer coupled to the first arm, whereby the indicating instrument provides indications responsive to the wear of the supporting means and the operating range of the transducer coupled to the first arm.

7. In a centerless plunge-grinding machine including grinding means for grinding workpieces; adjustable support means for supporting the workpieces; a measuring head including a movable arm for carrying out measurements on a point of the workpiece close to the support means and a position transducer coupled to the movable arm, measuring head being adapted to provide a signal responsive to the position and wear of the support means; circuit means connected to said head for receiving said signal; and drive means coupled to the circuit means for adjusting the position of the support means, the improvement comprising:

a second movable arm in said measuring head, said second arm being located to cooperate with a point of the workpiece diametrically opposite to said point close to the support means;

a second transducer in said measuring head, the second transducer being coupled to the second arm; further circuit means connected with the second transducer;

an adding unit coupled to said circuit means and further circuit means;

switch means located between said circuit means and adding unit and between said further circuit means and the adding unit;

an indicating device coupled to the adding unit for providing at least one indication among indications relating to the workpiece diameter, the wear of the support means, the position of the support means and the operating range of either of said first and second transducers; and a control group coupled to said adding unit for controlling the grinding machine.

* * * * *

UNITED STATES PATENT AND TRADEMARK OFFICE

CERTIFICATE OF CORRECTION

PATENT NO. : 4,055,027

DATED : October 25, 1977

INVENTOR(S) : Tomaso FREDDI

It is certified that error appears in the above-identified patent and that said Letters Patent are hereby corrected as shown below:

Column 3, line 15, change "bloc" to -- block --.

Column 6, line 31 (line 7 of Claim 7), before "measuring head" insert -- said --.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*